US006123209A

United States Patent [19]

Tseng

[11] Patent Number: 6,123,209

[45] Date of Patent: Sep. 26, 2000

[54] RACK

[76] Inventor: Chun-Hsien Tseng, No. 3, Ting-Hsi-Hsin, Lu-Man Tsun, Chu-Chi Hsiang, Chiayi Hsien, Taiwan

[21] Appl. No.: 09/369,062

[22] Filed: Aug. 5, 1999

[51] Int. Cl.[7] ..... A47F 5/00

[52] U.S. Cl. ..... 211/186; 211/187; 211/182; 248/165

[58] Field of Search ..... 211/186, 187, 211/189, 182; 248/165; 108/107, 111

[56] References Cited

U.S. PATENT DOCUMENTS

| | | | |
|---|---|---|---|
| 3,997,139 | 12/1976 | Young et al. | 248/165 |
| 4,175,666 | 11/1979 | Smith | 211/182 X |
| 4,391,454 | 7/1983 | Marsh et al. | 211/186 X |
| 5,065,873 | 11/1991 | Tseng | 211/187 |
| 5,407,084 | 4/1995 | Remmers | 211/182 X |
| 5,893,469 | 4/1999 | Nozawa | 211/189 X |
| 5,947,307 | 9/1999 | Battaglia et al. | 211/182 X |
| 5,960,968 | 10/1999 | Wang | 211/187 |

*Primary Examiner*—Robert W. Gibson, Jr.

*Attorney, Agent, or Firm*—Brinks Hofer Gilson & Lione

[57] ABSTRACT

A rack of a simple construction and having adjustable storage capacity is disclosed. The rack comprises at least two side frames of a generally inverted "U" shape arranged in parallel planes, each of said side frames having a pair of legs, each of said legs having at least one set of vertically aligned sockets in spaced arrangement along the length thereof, said sockets in said legs being aligned horizontally; a plurality of cross bars bridging said side frames to space apart said side frames, said cross bars being aligned horizontally and vertically, each of said cross bars having two plugs depending from the two ends thereof, respectively, for insertion into one of said sockets of one of said side frames and one of said sockets of the other one of said side frames; a plurality of horizontal support panels each being supported on one pair of said cross bars which are aligned horizontally, each of said support panels having a bottom face formed with a pair of channels adjacent opposed sides thereof for engaging said one pair of said cross bars, respectively; and a rubbery tightening member provided on each of the two ends of each of said cross bars, said tightening member having an abutment end to abut against a corresponding one of said legs of said side frames.

4 Claims, 6 Drawing Sheets

RACK

BACKGROUND OF THE INVENTION

1. Field of the Invention

The invention relates to a rack, more particularly to a rack of a simple construction which can be assembled by bare hands without the use of a tool and which can be extended or expanded as desired.

2. Description of the Related Art

Generally, racks commonly available in the market are of a design that provides fixed storage spaces for depositing or displaying objects or articles. The rack itself and the storage spaces therein cannot be suitably expanded as necessary. To improve upon such shortcoming, a rack constructed to have adjustable storage spaces, such as that shown in FIG. 1, has been developed. Such a storage rack, however, is structurally complicated and is troublesome to assemble.

Specifically, the rack of adjustable storage spaces in the prior art, shown in perspective view in FIG. 1, essentially comprises two side frames 1, a plurality of cross bars 2, a plurality of first clamp pieces 21 and a plurality of support panels 3. Each of the side frames 1 consists of a pair of juxtaposed subframes 11 of generally inverted "U" shape each having a pair of legs. Each pair of subframes 11 are integrally connected by a plurality of brace members 12 placed between two adjacent legs of the subframes 11 and welded thereto. The side frames 1 each have two bottom ends provided with two casters 14, respectively. Each of the cross bars 2 has two second clamp pieces 22 complementary to the first clamp pieces 21 provided at the two ends thereof. As best shown in FIG. 2, each second clamp piece 22 has two recesses 23 adapted to embrace partially two adjacent legs of the subframes 11, respectively, and a threaded hole 24 between the two recesses 23. Each of the first clamp pieces 21 is likewise provided with two recesses 25 and a threaded hole 26 thereon which correspond to the recesses 23 and threaded hole 24 of the second clamp pieces 22, respectively.

To assemble into a rack, the plurality of cross bars 2 are firstly mounted to each of the side frames 1 in a position bridging the two opposing pairs of legs of the two subframes 11 and at predetermined heights along the length of the legs of the subframes 11, the cross bars 2 in one of the side frames 1 being horizontally aligned with the cross bars 2 in the other one of the side frames 1. To attach a cross bar 2 to the legs of the subframes 11, the cross bar 2 is positioned such that two adjacent legs of the two subframes 11 are partially received in and abut against the two recesses 23, respectively, of the second clamp piece 22 at one end of the cross bar 2 while the other two adjacent legs are partially received in and abut against the two recesses 23, respectively, of the second clamp piece 22 at the other end of the cross bar 2. The first clamp pieces 21 are subsequently sleeved onto the outer side of the subframes 11 to mate with the second clamp pieces 22 on the cross bars 2, with the threaded hole 24 on each second clamp piece 22 aligned with the threaded hole 26 on each first clamp piece 21 and a threaded bolt 27 inserted therein. Thus, the cross bars 2 are mounted at predetermined heights on the side frames 1 through the clamping engagement of the clamp pieces 21,22. The support panels 3, which are rectangular in shape, are then placed and supported on the pairs of horizontally aligned cross bars 2, respectively, by a hook member 31 protruding from each of the four comers of the support panels 6 thereof and engaging the cross bars 2. To increase the stability of the assembled rack, two reinforcing rods 13 are further provided between the two side frames 1 in intersecting arrangement.

In use, the number of support panels 3 on the rack may be suitably increased or decreased to adjust the size and number of the storage spaces as required. The rack may be expanded sidewise by connecting another side frame to the two assembled side frame on either side thereof and mounting a suitable number of cross bars 2 and support panels 3 thereon, thereby increasing the capacity of the rack. While such a rack can achieve the intended effects, it is found that it still has the following shortcomings:

(1) Tools are necessary during assembly: To assemble the rack, the cross bars 2 are secured to the legs of the subframes 11 of the side frames 1 through the second clamp piece 22 provided at each of the two ends of the cross bars 2 in cooperation with the corresponding first clamp piece 21 together which clamps the legs of the subframes 11, the first and second clamp pieces 21,22 being secured together by the threaded connection of the threaded bolt or screw 27. In view of this, a tool is necessary to screw the threaded bolt 27 during assembly to be able to securely clamp the first and second clamp pieces 21,22 onto the side frames 1.

(2) The assembly operation is troublesome: During assembly of the rack, the second clamp pieces 22 on each cross bar 2 cooperate with corresponding first clamp pieces 21 to clamp the cross bars 2 to the side frames 1. The cross bars 2 are thus secured one by one to the side frame 1 using a tool. FIG. 1 shows five pairs of cross bars mounted on the two side frames 1. With a greater number of cross bars to be mounted one by one on the side frames 1, the assembly of the rack would be quite time-consuming and tedious.

(3) The reinforcing structure for increasing stability of the storage rack is troublesome and is a waste of material: For mounting various support panels 3, the rack is designed to have cross bars 2 spanning the opposing legs of the subframes 11, and corresponding hook members 31 provided at the four comers of the support panels 3. However, such a connection is not sufficiently secure. To increase the stability of the assembled rack, two reinforcing rods 13 are further provided between the two side frames 1. Such a design is not only more troublesome but also adds to the material cost.

Therefore, there is still room for improvement upon such a rack having adjustable storage spaces. The present invention is contrived with a view to alleviate the above disadvantages of the prior art rack in terms of assembly.

SUMMARY OF THE INVENTION

A main object of the present invention is to provide a rack having adjustable storage spaces which is convenient to assemble and has reduced structural parts.

The rack according to the present invention comprises at least two side frames of a generally inverted "U" shape arranged in parallel planes, each of said side frames having a pair of legs, each of said legs having at least one set of vertically aligned sockets in spaced arrangement along the length thereof, said sockets in said legs being aligned horizontally; a plurality of cross bars bridging said side frames to space apart said side frames, said cross bars being aligned horizontally and vertically, each of said cross bars having two plugs depending from the two ends thereof, respectively, for insertion into one of said sockets of one of said side frames and one of said sockets of the other one of said side frames; a plurality of horizontal support panels each being supported on one pair of said cross bars which are aligned horizontally, each of said support panels having a bottom face formed with a pair of channels adjacent opposed sides thereof for engaging said one pair of said cross bars, respectively; and a rubbery tightening member provided on each of the two ends of each of said cross bars, said tightening member having an abutment end to abut against a corresponding one of said legs of said side frames.

BRIEF DESCRIPTION OF THE DRAWINGS

Further advantages, features and details of the present invention will be elucidated in the light of the following description of the preferred embodiments thereof with reference to the annexed drawings in which.

DETAILED DESCRIPTION OF THE PREFERRED EMBODIMENTS

Figure 1:
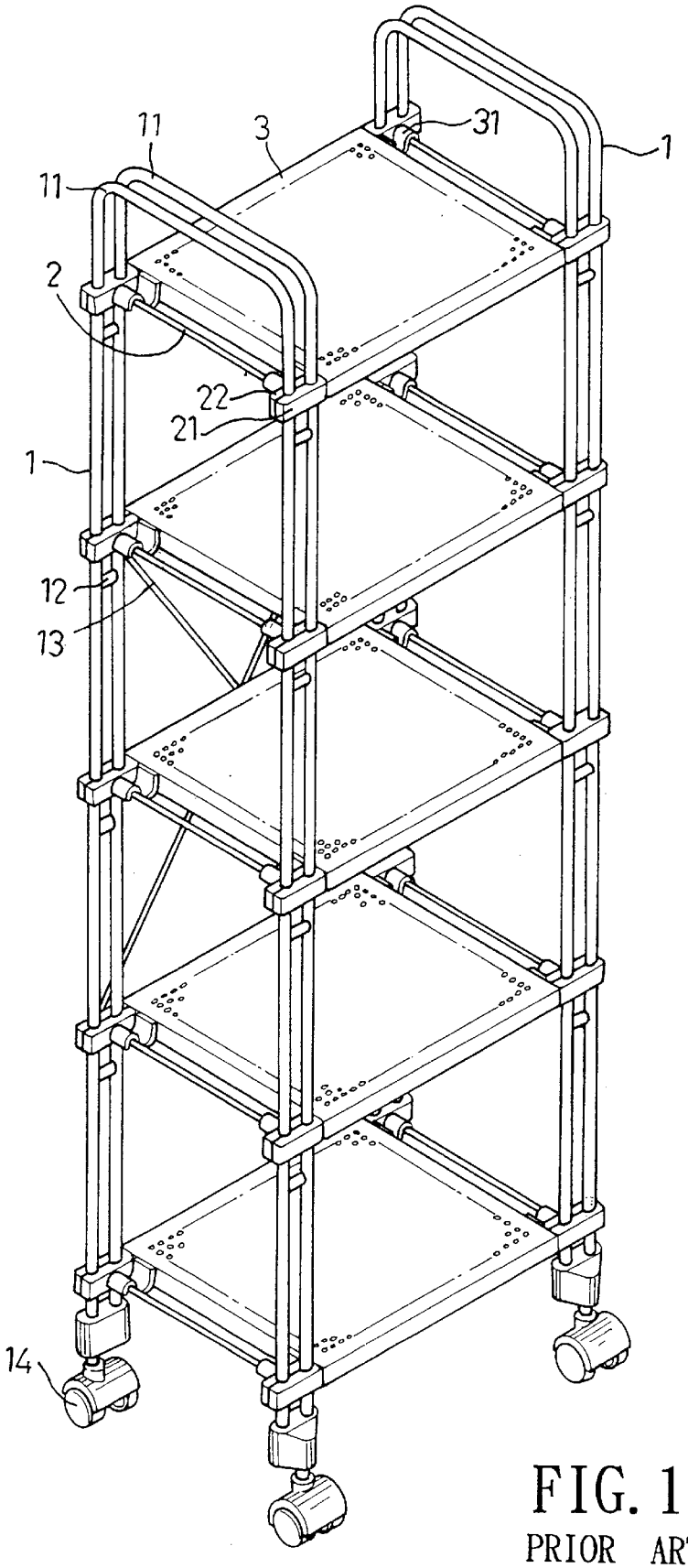
FIG. 1 PRIOR ART
FIG. 1 is a perspective view of a rack in the prior art.
Figure 2:
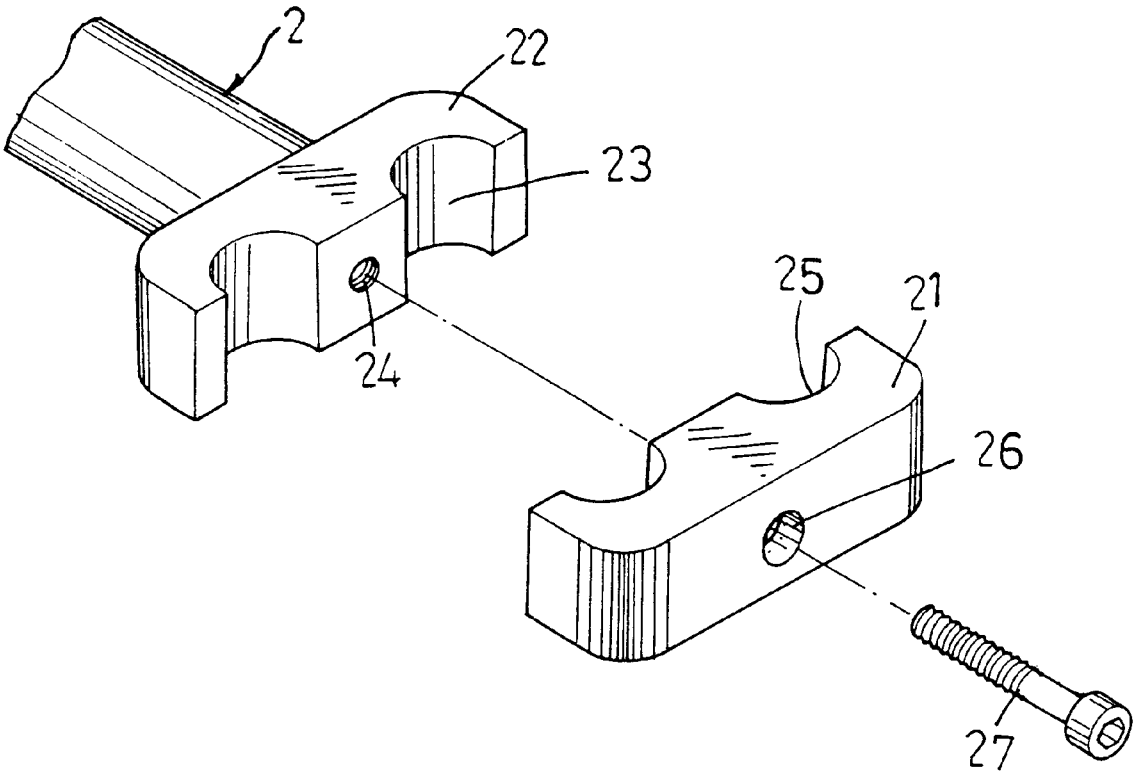
FIG. 2 PRIOR ART
FIG. 2 shows the clamp pieces used in the rack of the prior art shown in FIG. 1.
Figure 3:
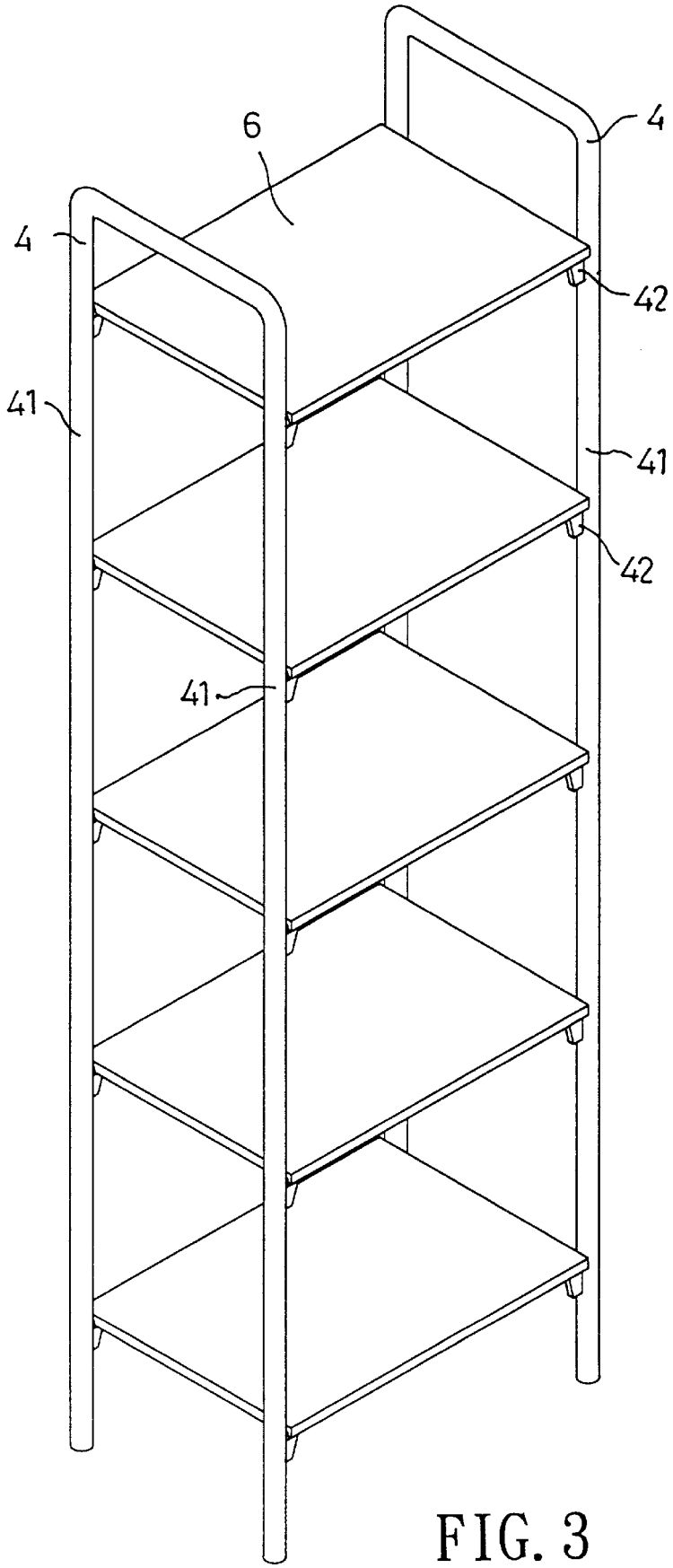
FIG. 3 is a perspective view of a first preferred embodiment of the rack according to the present invention.

A preferred embodiment of the rack according to the present invention will now be described with reference to FIGS. 3 and 4. As shown, the storage rack basically comprises two side frames 4, a plurality of cross bars 5 and a plurality of support panels 6.

The two side frames 4 are each of a generally inverted U-shape configuration having a pair of vertical legs 41. Each vertical leg 41 is provided with a set of vertically aligned sockets 42 in spaced arrangement along the length thereof, each of the sockets 42 having an upwardly-opening recess 43. The sockets 42 in one vertical leg 41 are horizontally aligned with the sockets 42 in the other vertical legs 41. The two side frames 4 are arranged in parallel planes and are spaced apart by the plurality of cross bars 5, each of which has one end mounted to a vertical leg 41 of one side frame 4 and another end mounted to a vertical leg 41 of the other side frame 4, as shown in FIG. 5. The cross bars 5 may be varied in length in accordance with the desired width of the storage space afforded by the finally assembled storage rack. The cross bars 5 each have two plugs 511 depending from the two ends thereof respectively, for insertion into one of the sockets 42 of one side frame 4 and one of the sockets 42 of the other side frame 4. Accordingly, the cross bars 5 are mounted in horizontally aligned pairs on the two side frames 4 along the legs 41 thereof. Referring to FIG. 4 in conjunction with FIGS. 5 and 6, the two ends of the cross bar 5 are formed with two openings 512, respectively, into each of which is inserted a rubbery tightening member 52. The rubbery tightening member 52 has an abutment end 522 with a concave abutment surface for abutment against a respective one of the legs 41 of the side frames 4, and an insert end 521 inserted into the corresponding opening 512 of the cross bar 5.

The support panels 6 are each horizontally disposed and supported on each pair of cross bars 5 which are horizontally aligned. Each support panel 6 has a bottom face formed with a pair of channels 61 adjacent the opposing sides thereof for engaging the pair of horizontally aligned cross bars 5 on which the support panel 6 rests.

Figure 4:
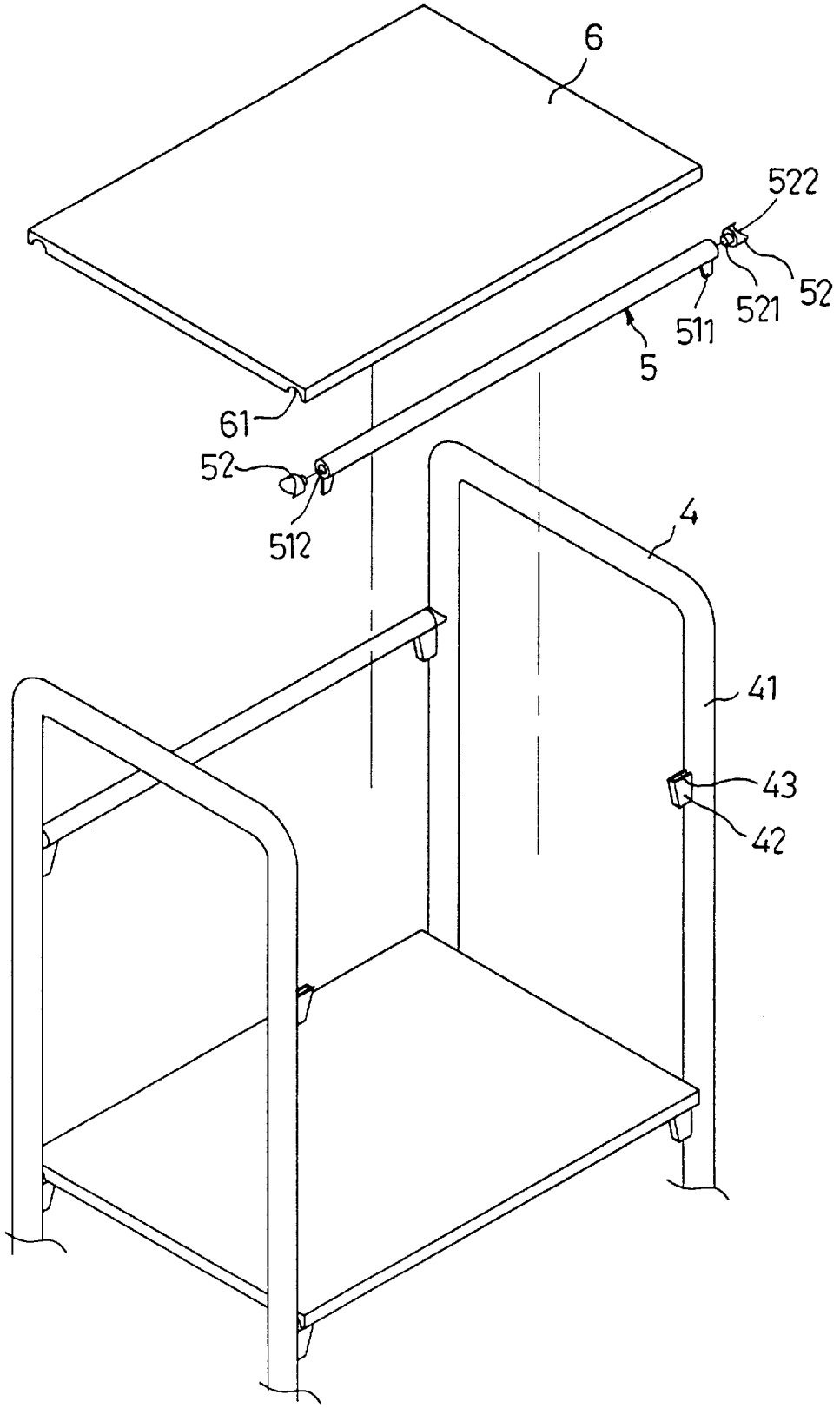
FIG. 4 is a partial exploded view of the first preferred embodiment.
Figure 5:
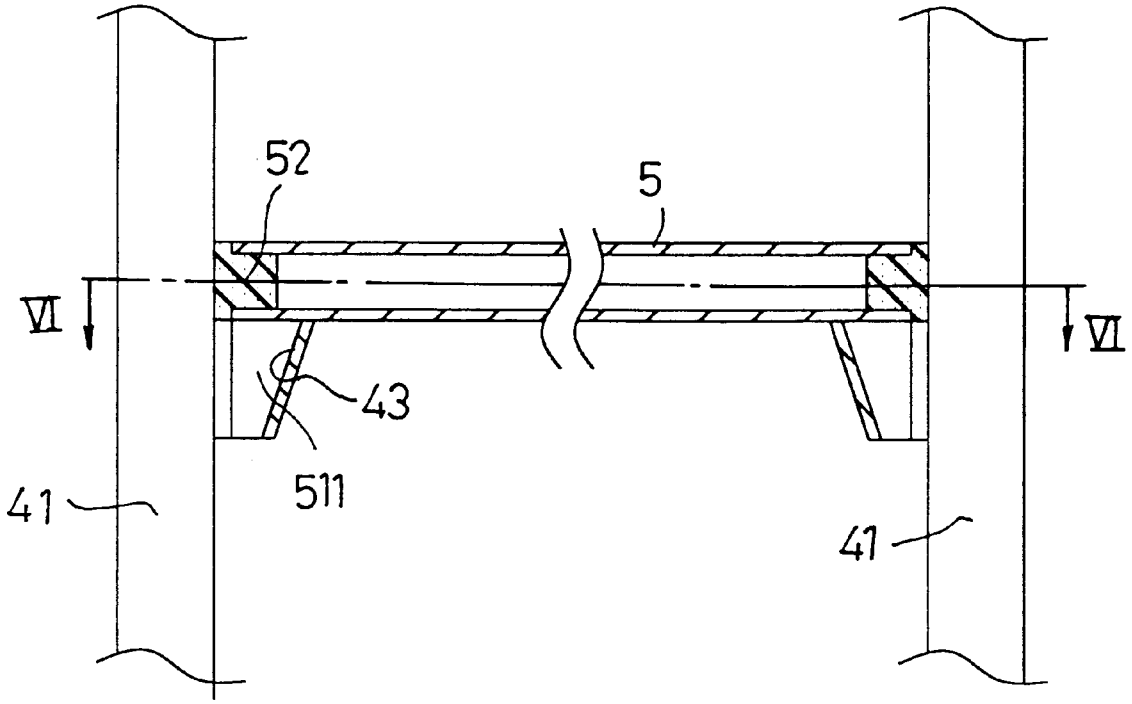
FIG. 5 shows the attachment of a crossbar to the side frames of the rack.
Figure 6:
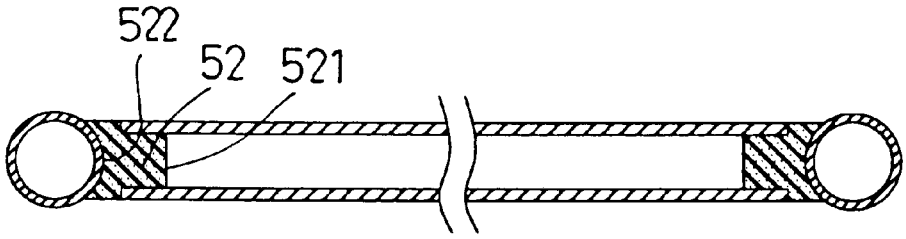
FIG. 6 is a sectional view taken along lines VI—VI of FIG. 5.

Referring to FIGS. 4 and 6, the manner of assembly of the storage rack will now be described. A rubbery tightening member 52 is inserted into each opening 512 at the two ends of each cross bar 5. One by one, the so assembled cross bars 5 are mounted to bridge the two side frames 4 by inserting the two plugs 511 of each cross bar into the recess 43 of one of the sockets 42 of one side frame 4 and into the recess 43 of one of the sockets 42 of the other side frame 4, with the two abutment ends 522 of the two rubbery tightening members 52 abutting against the two legs 41 spanned by the cross bar 5, respectively. Finally, a support panel 6 is positioned horizontally on top of a pair of horizontally aligned cross bars 5, with the two channels 61 engaging the pair of horizontally aligned cross bars 5. The above procedure is repeated to form a number of parallel support panels 6 on the rack. In accordance with the design, the number of support panels 6 may be increased or decreased as required, to allow the overall storage space to be suitably varied.

Figure 7:
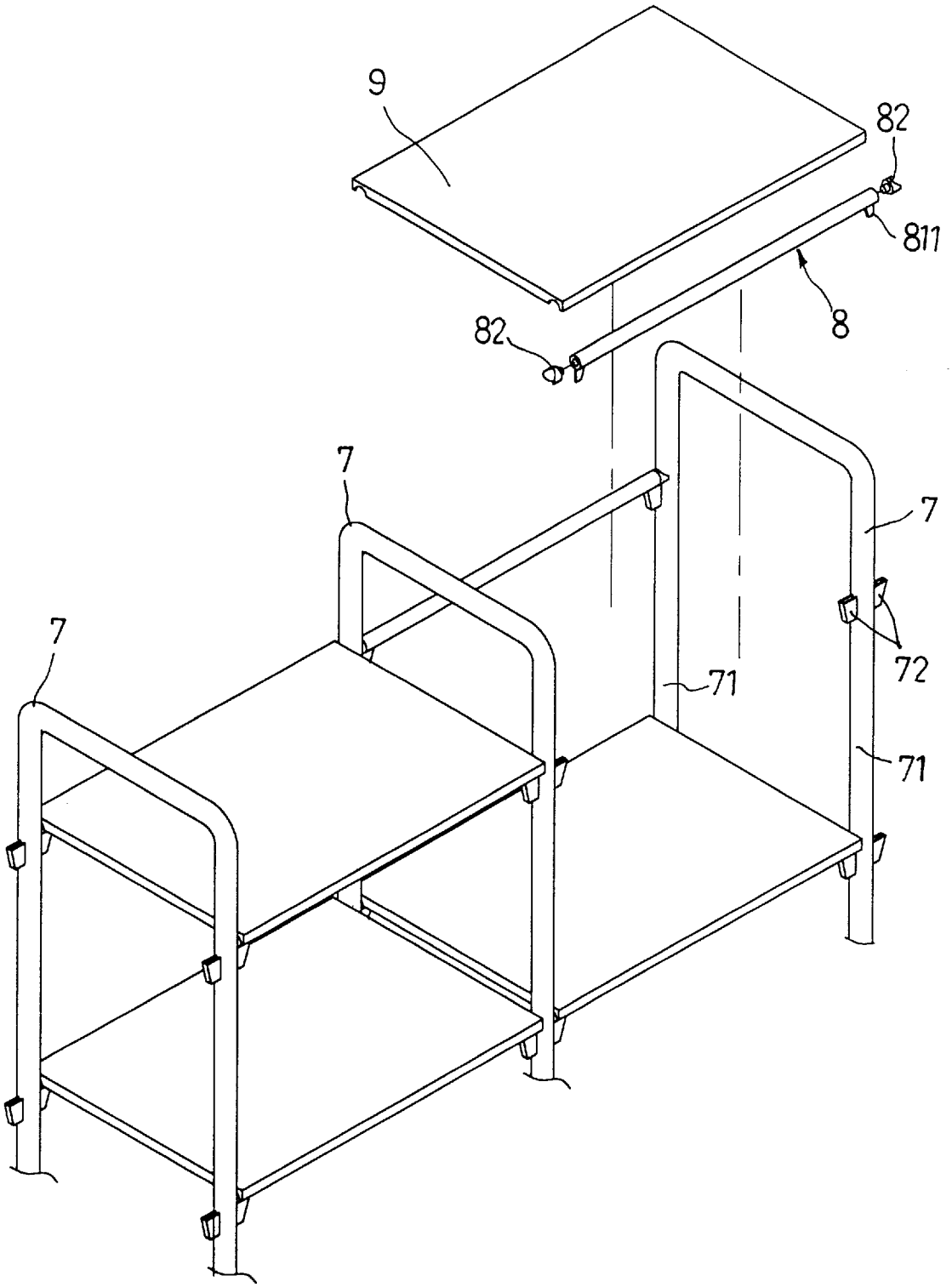
FIG. 7 is a perspective view of a second embodiment of the rack according to the present invention.

Referring now to FIG. 7, a second embodiment of the rack according to the present invention is shown. This second embodiment comprises three side frames 7, a plurality of cross bars 8 and a plurality of support panels 9. The construction of the components and the assembly manner are substantially the same as those of the first preferred embodiment described above. In other words, the side frames 7 each include a pair of legs 71, and each cross bar 8 is provided with a rubbery tightening member 82, as well as a plug 811, at the two ends thereof. This second embodiment differs from the first embodiment in that the pair of legs 71 of each side frame 7 are each provided with two sets of sockets 72 along the length thereof which are horizontally opposite to one another. The additional set of sockets allows the side-to-side connection of the three side frames 7 to form a wider rack assembly with greater number of support panels 9. The user may further assemble thereto a predetermined number of additional side frames 7 in association with additional cross bars 8 and support panels 9 to further expand the rack sidewise, to allow the overall width to be suitably extended on the two sides to increase the storage spaces.

It is worth mentioning here that the side frames 4,7 in the two embodiments may be further provided with casters at the bottom portion thereof for facilitating movement of the rack. Furthermore, if the rack is to be placed against a wall comer, the cross bars 5,8 may be bent to a certain angle or arranged in a geometric configuration such as an arcuate shape in accordance with the interior design of the room, so that the space can be efficiently utilized.

It can thus be appreciated that the present invention not only retains the features of the prior racks of being capable of suitably varying the storage spaces and of sidewise extension, but also possesses the following advantages:

(1) No tool is necessary for assembly: During assembly of the storage rack according to the present invention, the plugs 511 of the cross bars are simply inserted into the corresponding sockets 42 on the side frames 4 using bare hands and then the support panels 6 are placed on the pairs of horizontally aligned cross bars 5. Thus, no tool is necessary in the process.

(2) The structural parts and assembly are simpler: The structural parts making up the present invention generally include only the side frames 4, cross bars 5 and support panels 6, in which the connection between the side frames 4 and the cross bars are accomplished by the snap-fitting of the plugs 511 into the sockets 42. The support panels 6 are secured onto the cross bars 5 through engagement of the channels 61 formed at the bottom face of the support panels 6 with the cross bars 5. Such a design, in addition to the elimination of tool during assembly, renders the present invention not only to have simpler structural parts but also an easy and convenient assembly process of the structural parts.

(3) Reinforcing rods may be eliminated: The pair of side frames 4, after assembly, have a plurality of cross bars 5 mounted thereon for support. The cross bars 5 are locked against horizontal movement between the side frames 4 by the concave abutment surface of the abutment end 522 of the rubbery tightening member 52 abutting tightly against a corresponding leg 41 of a side frame 4, while being immobilized against vertical displacement by the engagement of the plugs 511 with the sockets 42. Consequently, the assembled rack has better stability and no additional reinforcing structures are necessary.

The design of the present invention retains the advantageous effects of the prior art in addition to its own advantageous effects such as having simple structural parts, convenient assembly and elimination of the use of tools in assembly.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

What is claimed is:

1. A rack comprising:

at least two side frames of a generally inverted "U" shape arranged in parallel planes, each of said side frames having a pair of legs, each of said legs having at least one set of vertically aligned sockets in spaced arrangement along the length thereof, said sockets in one of said legs aligned horizontally with said sockets in the other one of said legs;

a plurality of cross bars bridging said side frames to space apart said side frames, said cross bars being aligned horizontally and vertically, each of said cross bars having two plugs depending from the two ends thereof, respectively, for insertion into one of said sockets of one of said side frames and one of said sockets of the other one of said side frames;

a plurality of horizontal support panels each being supported on one pair of said cross bars which are aligned horizontally, each of said support panels having a bottom face formed with a pair of channels adjacent opposed sides thereof for engaging said one pair of said cross bars, respectively; and a rubbery tightening member provided on each of the two ends of each of said cross bars, said tightening member having an abutment end to abut against a corresponding one of said legs of said side frames.

2. The rack of claim 1, wherein said tightening member further has an insert end opposite to said abutment end, said insert end being inserted fittingly into each of the two ends of each of said cross bars.

3. The rack of claim 2, wherein said abutment end has a concave abutment surface.

4. The rack of claim 1, further comprising an additional one of said side frames disposed in parallel to said parallel planes at one side of one of said side frames opposite to the other one of said side frames, each of said legs of said one of said side frames having two sets of said sockets along the length thereof, said two sets of said sockets being horizontally opposite to one another.

* * * * *